US012741227B2

(12) United States Patent
Osnato

(10) Patent No.: US 12,741,227 B2
(45) Date of Patent: Sep. 22, 2026

(54) REMOTE CONTROL VEHICLE WITH NEON LIGHTS

(71) Applicant: WeCool Toys Inc., Point Pleasant, NJ (US)

(72) Inventor: Jeffrey Osnato, Medford, NJ (US)

(73) Assignee: WeCool Toys Inc., Point Pleasant, NJ (US)

( * ) Notice: Subject to any disclaimer, the term of this patent is extended or adjusted under 35 U.S.C. 154(b) by 25 days.

(21) Appl. No.: 17/456,297

(22) Filed: Nov. 23, 2021

(65) Prior Publication Data

US 2022/0161149 A1 May 26, 2022

Related U.S. Application Data

(60) Provisional application No. 63/201,212, filed on Apr. 19, 2021, provisional application No. 63/198,929, filed on Nov. 23, 2020.

(51) Int. Cl.

| | |
|---|---|
| ***A63H 27/00*** | (2006.01) |
| ***A63H 17/00*** | (2006.01) |
| ***A63H 17/28*** | (2006.01) |
| ***A63H 30/04*** | (2006.01) |

(52) U.S. Cl.

CPC ..... *A63H 27/00* (2013.01); *A63H 17/004* (2013.01); *A63H 17/28* (2013.01); *A63H 30/04* (2013.01)

(58) Field of Classification Search

CPC ..... A63H 17/004; A63H 17/28

See application file for complete search history.

(56) References Cited

U.S. PATENT DOCUMENTS

| | | | | |
|---|---|---|---|---|
| 6,540,583 | B1 * | 4/2003 | Hoeting | A63H 17/004 446/431 |
| 6,692,333 | B2 | 2/2004 | Kislevitz et al. | |
| 7,214,119 | B2 | 5/2007 | Lucas et al. | |
| 7,694,705 | B2 * | 4/2010 | Yokobori | B60C 11/02 446/454 |
| 7,806,371 | B2 | 10/2010 | Troutman | |
| 8,976,511 | B1 * | 3/2015 | Roberts | A63H 17/262 361/728 |
| 9,950,271 | B2 | 4/2018 | Sofman et al. | |

(Continued)

FOREIGN PATENT DOCUMENTS

| | | | | |
|---|---|---|---|---|
| CN | 205386337 | U | 7/2016 | |
| DE | 102006029577 | A1 | 12/2007 | |
| WO | WO-0009232 | A1 * | 2/2000 | A63H 17/28 |

OTHER PUBLICATIONS

Examiner's Search Strategy and Results in PCT/US2021/060534, dated Jan. 15, 2022, 5 pages.

(Continued)

*Primary Examiner* — Eugene L Kim
*Assistant Examiner* — Alyssa M Hylinski
(74) *Attorney, Agent, or Firm* — McKee, Voorhees & Sease, PLC

(57) ABSTRACT

A remote control vehicle comprises light fixtures, which when operated at high speeds, can create a neon glow in its wake. The remote control vehicle has at least eight distinct color combinations, can spin and flip in three hundred sixty degree stunts, and travel through all terrains. A remote control is responsible for remotely communicating aspects related to the control of the remote control vehicle, such as speed and drifting.

12 Claims, 10 Drawing Sheets

(56) References Cited

U.S. PATENT DOCUMENTS

| | | | | |
|---|---|---|---|---|
| 10,434,429 | B2 | 10/2019 | Kovach, II et al. | |
| 10,738,972 | B1 * | 8/2020 | Kelly | F21V 14/025 |
| 2004/0082268 | A1 * | 4/2004 | Choi | A63H 17/004 446/454 |
| 2004/0082269 | A1 * | 4/2004 | Wright | A63H 30/04 446/456 |
| 2006/0009118 | A1 * | 1/2006 | Fosbenner | A63H 17/28 446/438 |
| 2007/0049159 | A1 * | 3/2007 | Kulis, II | A63H 17/28 446/438 |
| 2008/0070472 | A1 * | 3/2008 | Campbell | A63H 17/008 446/429 |
| 2008/0113578 | A1 * | 5/2008 | McAlaine | A63H 33/22 446/219 |
| 2008/0268744 | A1 * | 10/2008 | Jones | A63H 17/004 446/466 |
| 2009/0075557 | A1 * | 3/2009 | Arriola | A63H 33/22 446/438 |
| 2010/0243797 | A1 * | 9/2010 | McNutt | A63H 27/02 244/102 R |
| 2014/0221111 | A1 * | 8/2014 | Picolet | A63H 18/00 472/89 |
| 2017/0010622 | A1 | 1/2017 | Pedersen et al. | |

OTHER PUBLICATIONS

International Search Report and Written Opinion in PCT/US2021/060534, mailed Feb. 15, 2022, 11 pages.

YouTube video entitled: "DJI Phantom 4 Pro Plus Drone Kit," uploaded Jun. 20, 2018 by user "technuba" [retrieved on Feb. 24, 2022]. Retrieved from the Internet: <https://www.youtube.com/watch?v=XXqAajKpuT8>, 3 pages.

YouTube video entitled: "The Amazing Lume CUBEs attached to a Drone (day and night flight)," uploaded Aug. 29, 2018 by user "Captain Drone" [retrieved on Feb. 24, 2022]. Retrieved from the Internet: < https://www.youtube.com/ watch?v=DsifqJIx-b0>, 3 pages.

Glowyzoey, Adult LED Stickman Costume, https://glowyzoey.com, pp. 1-9, 2022.

TRACER 2, "Performance Safety Visibility Vest", https://www.noxgear.com/tracer2, pp. 1-21, 2022.

* cited by examiner

REMOTE CONTROL VEHICLE WITH NEON LIGHTS

CROSS REFERENCE TO RELATED APPLICATIONS

This application claims priority under 35 U.S.C. § 119 to provisional patent applications U.S. Ser. No. 63/198,929, filed Nov. 23, 2020, and U.S. Ser. No. 63/201,212, filed Apr. 19, 2021. The provisional patent applications are herein incorporated by reference in their entireties, including without limitation, the specification, claims, and abstract, as well as any figures, tables, appendices, or drawings thereof.

FIELD OF THE INVENTION

The present invention relates generally to an apparatus and corresponding method of use in at least the toy industry. More particularly, but not exclusively, the present invention relates to a remote control vehicle with light fixtures that glow like neon.

BACKGROUND OF THE INVENTION

The background description provided herein gives context for the present disclosure. Work of the presently named inventors, as well as aspects of the description that may not otherwise qualify as prior art at the time of filing, are neither expressly nor impliedly admitted as prior art.

Children love toys, games, and activities. For children, toys, games, and activities are more than just fun. Most provide at least some opportunity for children to learn. The best toys engage the senses and spark imaginations. The best activities encourage children to interact with others and teach teamwork.

From a very early age, children are eager to learn more about the world around them. Every new shape, color, texture, taste, and sound presents an opportunity to learn more. Parents quickly identify giving their children toys that are safe and stimulating will help their children discover their senses. Rattles and toys that make music are favorites of infants. Toys with contrasting colors are fascinating to babies and stimulate their developing vision. As they grow, infants can use toys to explore object permanence and cause and effect relationships. They also need objects such as blocks to help them build motor skills and hand-eye coordination.

Toddlers can play with a wider variety of toys than infants. Toddlers may still enjoy some of the toys they played with as babies, however they also need that are designed with their increased capability to learn in mind. Even the same blocks they played with previously can provide them with new and different educational opportunities as their knowledge expands. Shape sorters are great for toddlers. They teach them how to match similar items and provide parents the opportunity to teach them the names of the shapes. Lego® blocks, for example, provide an opportunity to learn more about colors and symmetry developing a child's motor skills.

When children reach schooling age, parents and teachers shift their focus from helping children discover their senses to developing a child's aptitude for lingual (e.g., written and spoken), numeric, memorial, and social skills. There are a lot of toys that encourage this type of learning, from simple alphabet puzzles to high-tech electronic gadgets. These toys help give children a head start by introducing them to the things they will be learning in school. Kids who are in school can supplement their learning with recreational and educational toys. Giving children the opportunity to have fun while practicing the things they are learning in school will increase their retention of those things.

Children often make an emotional connection with their toys. Not surprisingly, the value a child assigns to any given collection is not monetary but sentimental. Thus, some connections are stronger than others. The collections allow children to relive previous experiences and connect themselves to a period or to a time they feel strongly about. This in effect helps ease insecurity and anxiety and allows the past to continue to exist in the present.

It is often a challenge for creators of games and activities to garner the attention of a child while still creating a strong emotional connection thereto. Often times, solutions in the art rely solely on the use of screen-time. Think video games, phone apps, and the like. It is however known children who spend too much time with screen-time activities score lower on language and thinking tests, and in extreme cases, screen-time can cause thinning of the brain's cortex, the area of the brain related to critical thinking and reasoning. It is thus essential that children remain engaged in outdoor activities, such as playing with toys to foster imagination and creativity, exploring, and playing with other children to develop appropriate social skills.

Radio-controlled ("RC") models such as RC vehicles are well equipped for such competition, and can employ technology that keeps the attention of children and educates them in the process. RC models emulate real vehicles. At the present moment, said vehicles are being tricked out with neon lighting, as shown in FIG. 1. This trend however is driven merely by aesthetics because such neon lights are likely not street-legal.

The technical benefits of the neon lighting thus go underutilized, and there exists a need to develop technologies in other technical fields which can utilize all of the benefits of said lighting. The art of RC models is particularly ripe for improvement. However, there remain many questions relating to if and how these effects can be achieved in RC models without affecting the functionality of the RC model itself. The present disclosure thus aims to identify and solve these technical questions.

Finally, there also exists a broader need in the art for toys which can garner attention of children with the same effectiveness as those which employ screen-time but do not suffer from those detrimental effects occurring from excessive use of the same.

SUMMARY OF THE INVENTION

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the present invention to improve on or overcome the deficiencies in the art.

It is a further object, feature, and/or advantage of the present invention to employ a single controller to control both motion of the vehicle and neon light fixtures located thereon. The neon light fixtures referenced herein can be fabricated in curving artistic shapes, even to form particular alphanumeric characters or images.

It is still yet a further object, feature, or advantage of the present invention to be able to use the toy at night and/or in other devoid of sufficient light.

It is still yet a further object, feature, or advantage of the present invention to improve hand-eye coordination of children, teach children about the anatomy of automobiles, improve children's use of electronics and radio communications, and promote exploration of the outdoors.

Any suitable vehicle can be employed, including but not limited to: land-based automotive vehicles, such as cars, trucks, and all-terrain vehicles ("ATVs"); railed vehicles, such as trains and trams; nautical vehicles, such as boats and submarines; aerial vehicles, such as drones, planes, helicopters, and model spacecraft (e.g. rockets); and any combination thereof.

Several means for powering motors within the remote controlled vehicles are contemplated, including those which power the motor through the combustion of gasoline, employ the use of electronic means (e.g. a battery), and even clockwork (e.g. windup and spring-powered clockwork). Moreover, hybrids of the several types of powering means can be used.

It is still yet a further object, feature, or advantage of the present invention to provide a toy which can be used by children of different skillsets and skill levels. For example, some models can be provided which require the child to initially assemble the toy according to instructions provided therewith. Such assembly can allow for customization of the toy, such as where removable and distinctly single-colored LED light fixtures are provided separately.

It is still yet a further object, feature, or advantage of the present invention to provide a child the ability to engage in an activity which can be practiced along and/or while playing with other children. For example, a means for engaging social media may be provided with the toy.

It is still yet a further object, feature, or advantage of the present invention to provide a toy that may be played with in a wide variety of applications. For example, children can collect different makes and models of toy automobile, play with individual components of the toy (e.g., retrofit toy accessories to the toy automobile, "repair" electromechanical components of the toy upon failure, etc.), or arrange components of the toy for easy storage until later play.

It is still yet a further object, feature, or advantage of the present invention to provide a toy that is safe (e.g., non-toxic, eliminates choking hazards, etc.), cost effective, and durable. For example, channels can be used which recess into the vehicle a sufficient distance to house neon lights therewithin without danger that the lights will become damaged if the vehicle crashes. Alternatively, in lieu of channels, the body of the remote control vehicle can be transparent and the neon lights permanently housed therewithin. Where the device is intended for night-time use, said channels can even be employed toward the vehicle's outermost exterior so that operators can easily determine exactly where the outer bounds of the vehicle lie.

At least one embodiment disclosed herein comprises a distinct aesthetic appearance. Ornamental aspects included in such an embodiment can help capture a child's attention and/or identify a source of origin of a product being sold. Said ornamental aspects will not impede functionality of the present invention.

It is still yet a further object, feature, or advantage of the present invention to practice methods which facilitate use, manufacture, assembly, and repair of a remote control vehicle accomplishing some or all of the previously stated objectives.

It is still yet a further object, feature, or advantage of the present invention to incorporate a remote control vehicle into a system or kit accomplishing some or all of the previously stated objectives.

These and/or other objects, features, advantages, aspects, and/or embodiments will become apparent to those skilled in the art after reviewing the following brief and detailed descriptions of the drawings. Furthermore, the present disclosure encompasses aspects and/or embodiments not expressly disclosed but which can be understood from a reading of the present disclosure, including at least: (a) combinations of disclosed aspects and/or embodiments and/or (b) reasonable modifications not shown or described.

BRIEF DESCRIPTION OF THE DRAWINGS

Several embodiments in which the present invention can be practiced are illustrated and described in detail, wherein like reference characters represent like components throughout the several views. The drawings are presented for exemplary purposes and may not be to scale unless otherwise indicated.

FIG. 13 also emphasizes product packaging of the ATV, said product packaging including a viewing window to showcase the product and a predefined point of failure, which if broken by lifting where instructed allows purchasers of the product to access the product.

Figure 1:
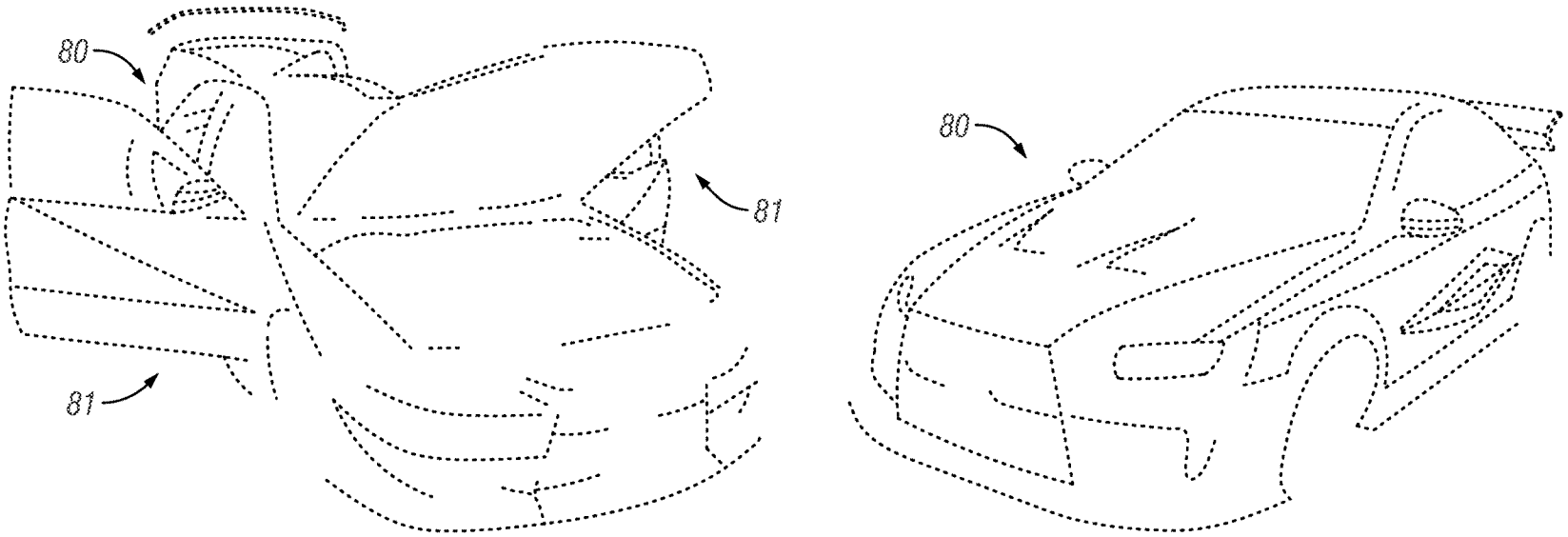
FIG. 1 (PRIOR ART)
FIG. 1 identifies a neon trend emerging for real automobiles.
Figure 2:
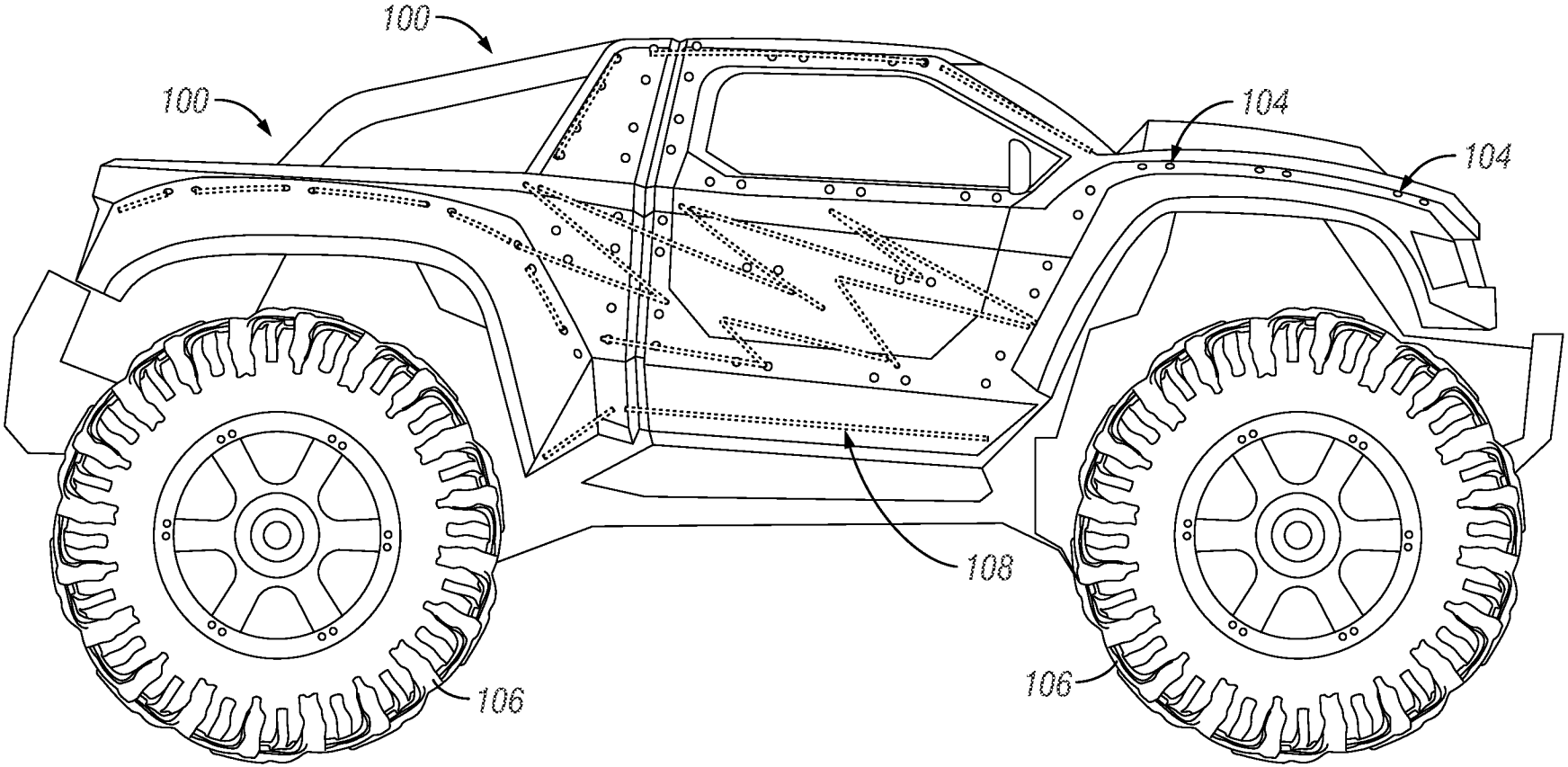
FIG. 2 depicts a side, elevational view of a remote control truck retrofit with customizable lights selected to emphasize a first exemplary configuration of the present disclosure.
Figure 4:
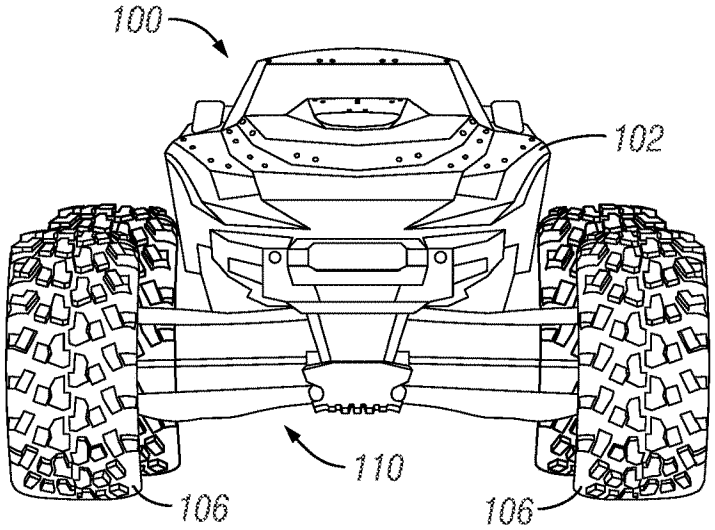
FIG. 4 lays out a front, elevational view of the remote control truck of FIG. 3 in an adjacent position on the page with a similar scale.
Figure 3:
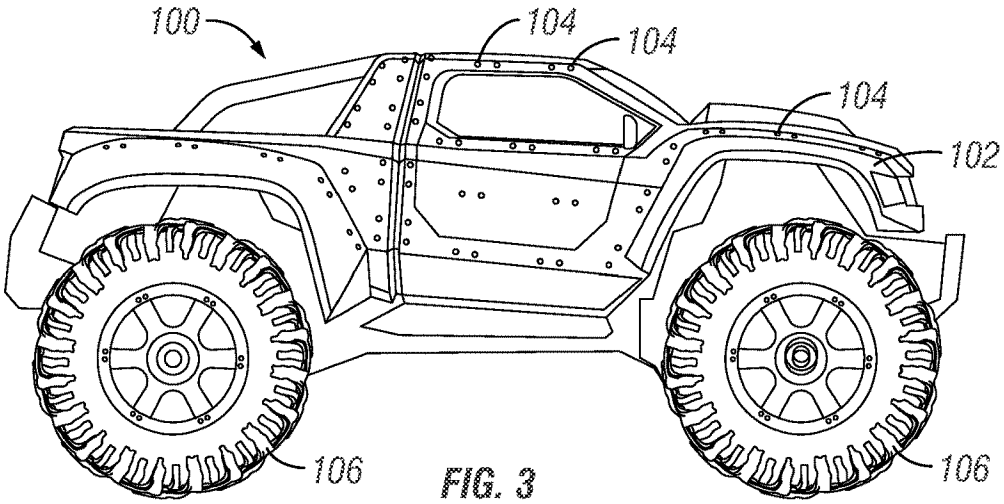
FIG. 3 lays out a side, elevational view of a remote control truck prior to being retrofit with any customizable lights.
Figure 5:
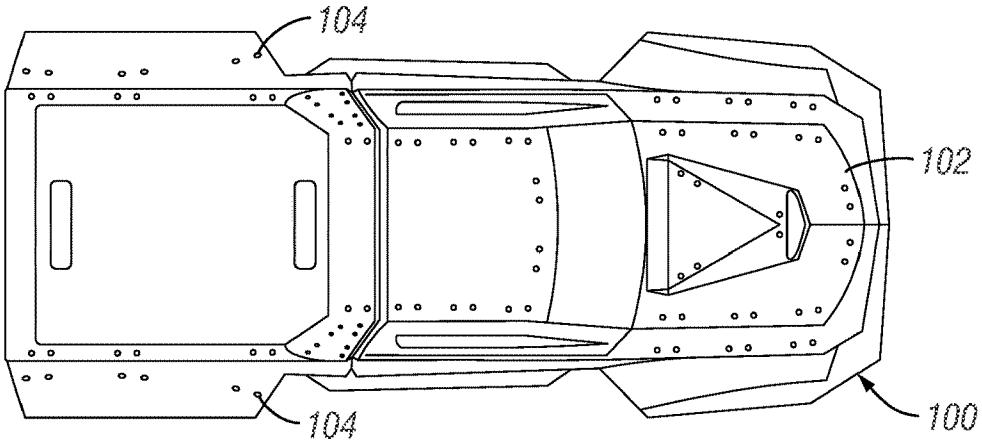
FIG. 5 lays out a top, elevational view of the remote control truck of FIG. 3 in an adjacent position on the page with a similar scale.
Figure 6:
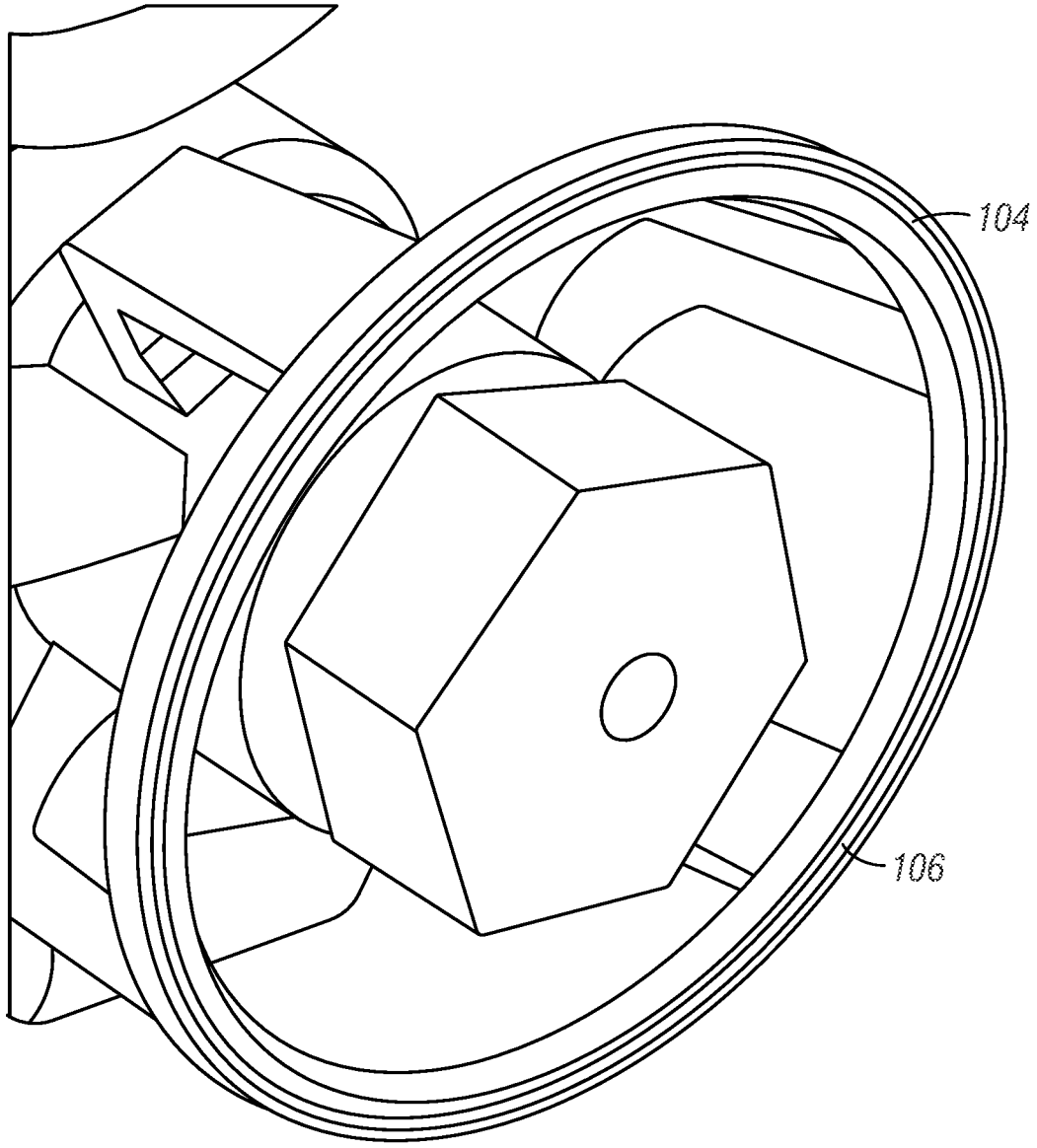
FIG. 6 illustrates a detailed, perspective view of a wheel assembly having channels specially adapted and/or shaped light fixtures are housed, FIG. 6 further showing said wheel assembly in a non-lit configuration.
Figure 7:
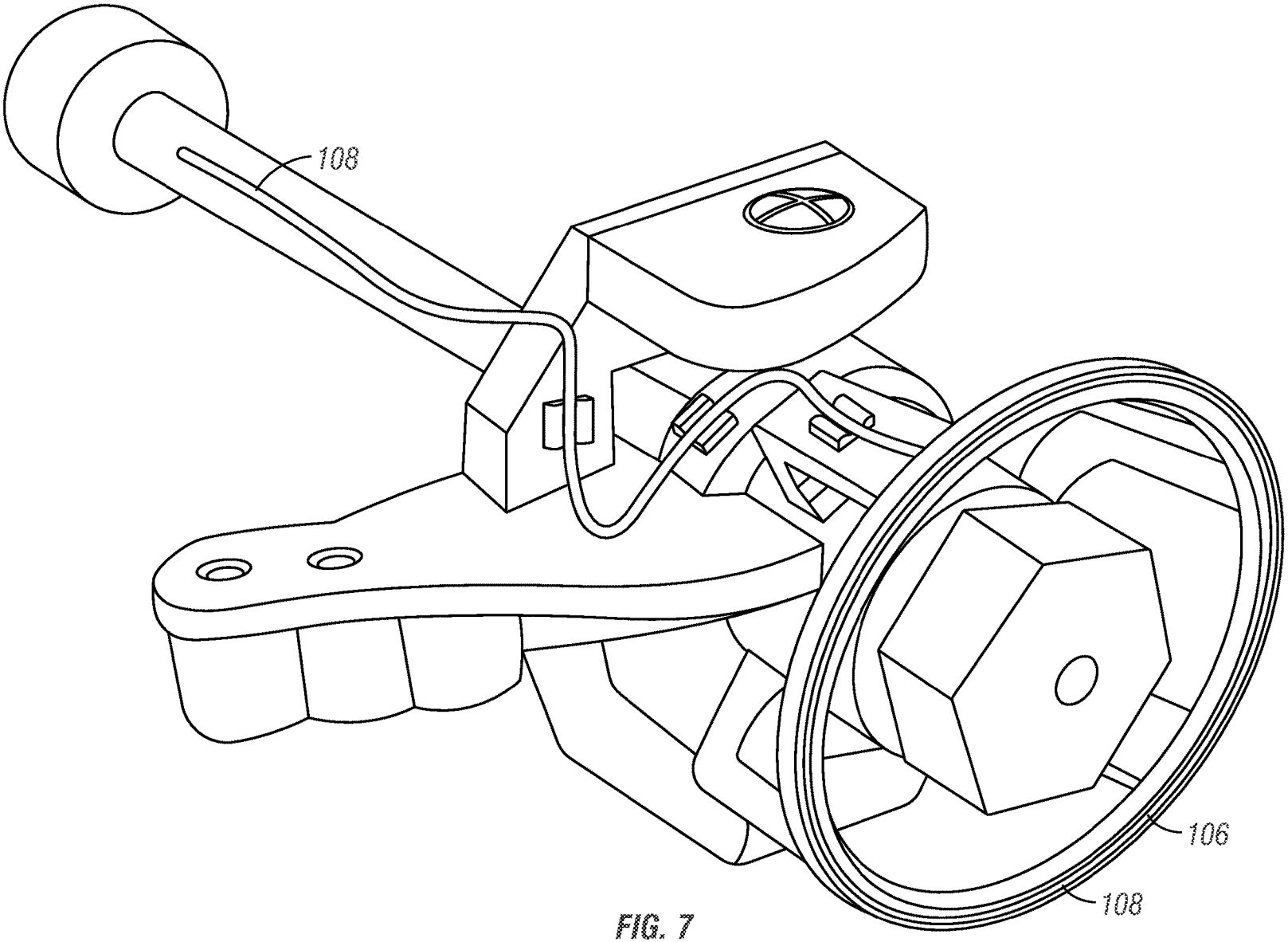
FIG. 7 illustrates an environmental, operative view of a wheel assembly having a wired connection traversing a distance of at least a significant portion of an axle of a remote control automobile and capable of delivering power to said light fixtures of FIG. 6, FIG. 7 further showing wheel assembly in a lit configuration.
Figure 8:
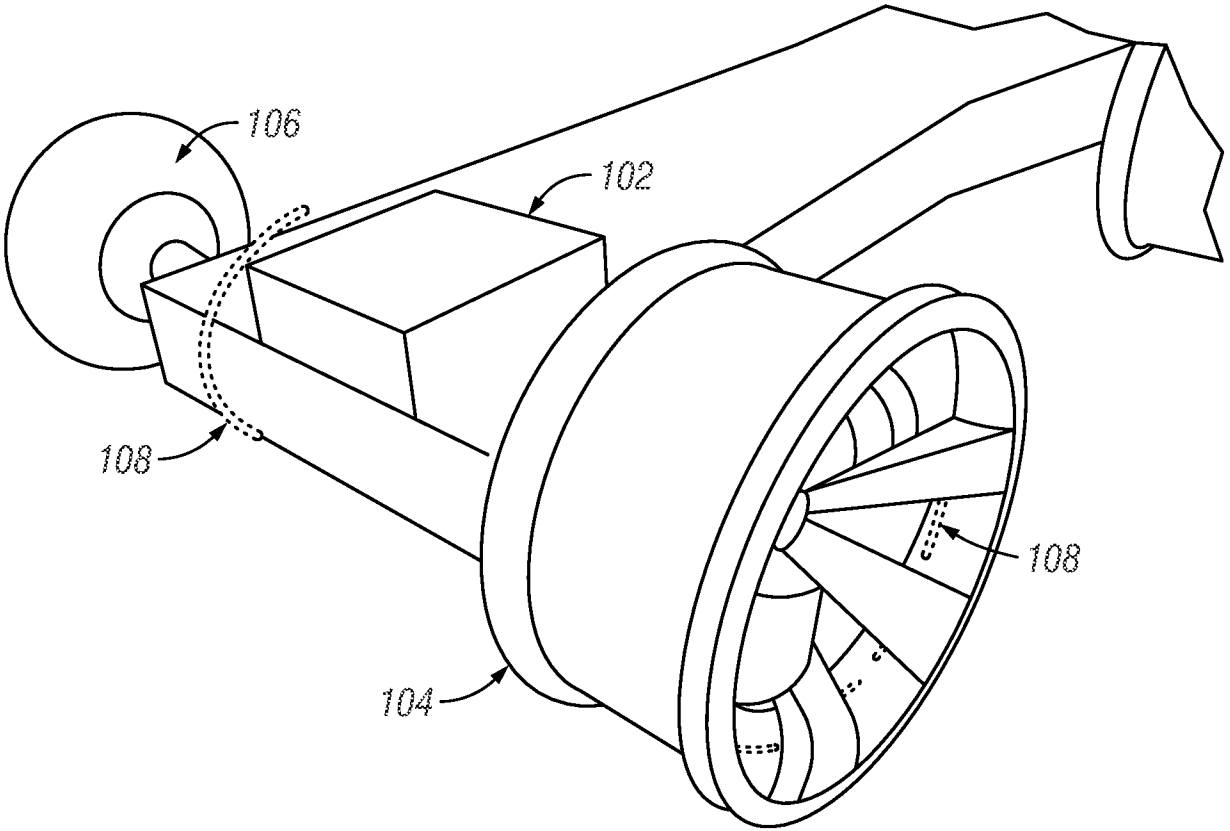
FIG. 8 captures a photographic, contrastive view of a remote control vehicle employing electroluminescent (EL) wires within channels of a wheel.
Figure 9C:
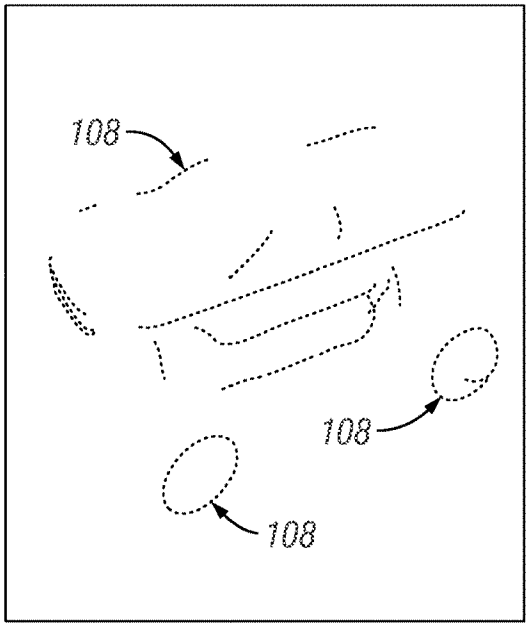
FIGS. 9A-C illustrates a method for customizing the aesthetic look of a remote control vehicle with lighting fixtures according to some aspects of the present disclosure.
Figure 9B:
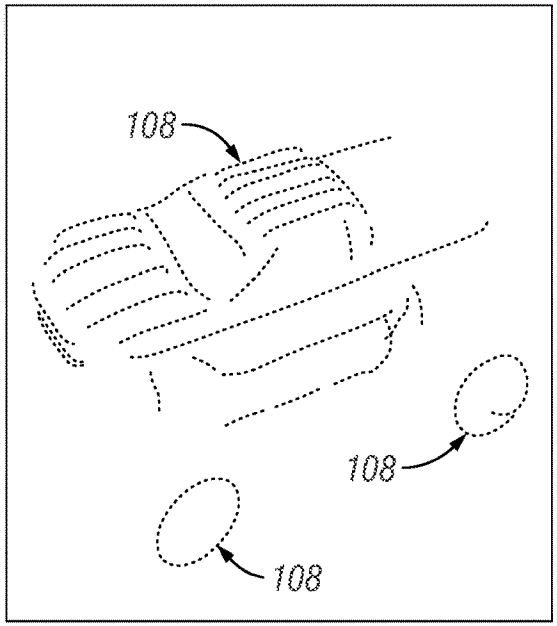
Figure 9A:
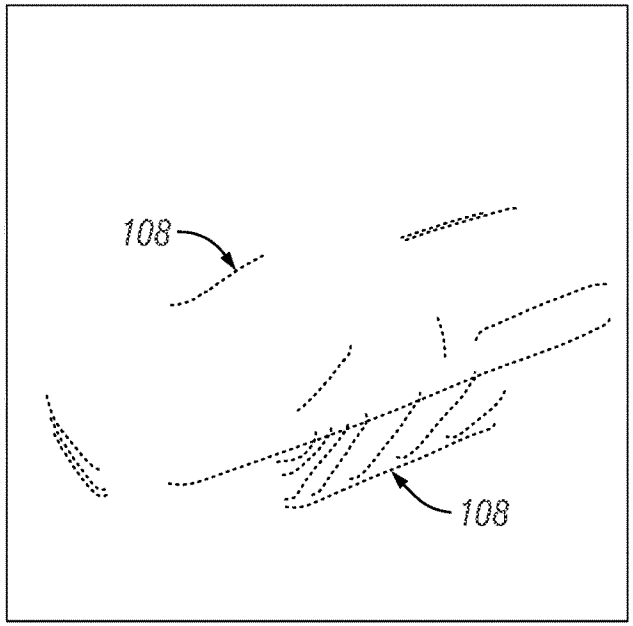

An artisan of ordinary skill need not view, within isolated figure(s), the near infinite number of distinct permutations of features described in the following detailed description to facilitate an understanding of the present invention.

DETAILED DESCRIPTION OF THE INVENTION

The present disclosure is not to be limited to that described herein. Mechanical, electrical, chemical, procedural, and/or other changes can be made without departing from the spirit and scope of the present invention. No features shown or described are essential to permit basic operation of the present invention unless otherwise indicated.

Referring now to the figures, several embodiments of a remote-control vehicle 100 is shown in FIGS. 2-14. The remote control vehicle 100 is preferably a radio-controlled model, however more means of remotely communicating are envisioned. Non-limiting features of the invention follow.

A body 102 of the model can emulate shape of road vehicles, watercraft, aircraft, spacecraft, and the like. Channels 104 within the body 102 and/or wheels 106 are specially adapted and/or shaped to house light fixtures 108 therein.

The wheels 106 are preferably high traction, all-terrain (e.g. premium rubber) tires which allow for superior road holding/handling, i.e., the ability to corner, accelerate, brake, and maintain directional stability when moving in steady state condition. Coupled with the use of internal, elastic coil springs, a suspension system-like effect can be created to provide for a smoother ride still supporting said road holding/handling. Where less than four wheels 106 are used, active-balance technology (such as that utilized in toy hoverboards) can be employed to promote stability.

Artificial lighting or light fixtures including EL wires may be implemented within the apparatus or system to achieve a practical or aesthetic affect consistent with the objects of the present disclosure, such as illuminating an area for visibility or for warning others about a potential hazard. Nonlimiting examples of artificial lighting include incandescent lamps, halogen lamps, parabolic aluminized reflector lamps, fluorescent lamps, electrodeless or induction lamps, laser lamps, light emitting diode ("LED") lamps, electron-stimulated luminescence lamps, combustion-based lamps (e.g., gas lamps, oil lamps), arc lamps, gas discharge lamps, and high-intensity discharge (HID) lamps. Light fixtures generally require a power source, even if the power source is not immediately apparent to the naked eye.

In particular, the light fixtures 108 are preferably LEDs emulating effects of neon lighting so as to best grab the attention of a child and to further promote visibility of the remote control vehicle 100 in situations of low lighting, such as outdoor use at night. For this reason, it can be highly beneficial to install the lights 108 lights within the channels 104 of the wheels 106 such that the lights do not spin with the wheel 106. Such a configuration is possible with the setup seen in FIGS. 6-8 and 9A-9C, which show the channels being associated with the stator of the wheel 106 (e.g. the frame connecting the wheel 106 to the rest of the stationary components of the body 102), rather than the rotor (which is powered by a motor and causes rotation of the tires). Embodiments where the lights 108 spin with the tires because they are placed thereon are still possible. Further, there can still exist in some limited embodiments the use of mechanical components permitting free and/or counter rotation, such as bushings or bearings, such that rotation in the lights 108 may be permitted but is not directly driven by rotation of the tires. In such embodiments, rotation of the lights 108 may be faster or slower than rotation of the wheels 106.

Single colored LEDs or multiple colored LED modules capable of changing color can be employed, depending on the intended application/configuration of the remote control vehicle 100. In preferred embodiments, the light fixtures 108 of some channels are similarly sized and thus interchangeable with at least some of the light fixtures 108 of other distinct locations, or, at the very least, can be replaced with light fixtures of other colors which are also included with the initial kit 150 provided to the user. To allow for even further customization of the aesthetics of the remote control vehicle 100, other objects which product neon effects can be provided therewith. For example, neon glow paints, markers with neon ink, phosphorescent ("glow-in-the-dark" materials), etc. can be provided.

A remote control 112 provided with the remote control vehicle 100 is preferably a 2.4 GHz transmitter having the capability to access more than one channel of a particular radio frequency. The remote control 112 preferably has the ability to control both propulsion and steering of the remote control vehicle 100 and the ability to control power and color of the light fixtures 108 located thereon, though such features are not required for the device to operate.

Regardless of whether the remote control 112 can or cannot control aspects related to the light fixtures 108 located thereon, there preferably exists another switch and/or control means, such as one located on the remote control vehicle itself which can manually allow power to or kill power to the light fixtures 108. Other similar "kill switches" and/or safety mechanisms can be associated with the motor so that, in the case of emergency, there exists means for preventing injury to users of the remote control vehicle 100. The emergency stop feature or other safety mechanisms may need user input or may use automatic sensors to detect and determine when to take a specific course of action for safety purposes, such as to prevent the motor for overheating.

The remote control 112 will include a user interface allowing for the user to interact with the remote control vehicle 100. The user interface can be a digital interface, a command-line interface, a graphical user interface ("GUI"), oral interface, virtual reality interface, or any other way a user can interact with a machine (user-machine interface). For example, the user interface ("UP") can include a combination of digital and analog input and/or output devices or any other type of UI input/output device required to achieve a desired level of control and monitoring for a device. Examples of input and/or output devices include computer mice, keyboards, touchscreens, knobs, dials, joysticks, switches, buttons, speakers, microphones, LIDAR, RADAR, etc. Input(s) received from the UI can then be sent to a microcontroller to control operational aspects of a device.

The remote control 112 can include an RF antenna which extends and sends input to the remote control vehicle 100. The user can, for example, control the velocity of remote control vehicle 100 by using an input control of the remote control 112, which in turn sends input control data to the remote control vehicle 100 via the RF antenna. The remote control 112 preferably further includes a system bus which interconnects the RF antenna, aforementioned input control, a power switch, a computer interface, more input controls, a data toggle switch, ROM, an RF transceiver, and a central processing unit ("CPU"). The power switch is used to turn power on or off for the remote control 112. The computer interface provides connectivity between the remote control 112 and other computing devices. The data toggle switch is similar to a Wi-fi on-off switch in that it can toggle between sending data to the remote control vehicle 100 and the remote control 112, depending upon preference. The ROM stores executable instructions for analyzing and modifying user input. During operation, the CPU executes the instructions stored in ROM, which analyzes and modifies control data input according to the limitations set in car performance features. Other external flash memory can be employed to stores further vehicle performance related data, even when remote control vehicle 100 and/or remote control 112 are turned off.

The user interface module can include a display, which can act as an input and/or output device. More particularly, the display can be a liquid crystal display ("LCD"), a light-emitting diode ("LED") display, an organic LED ("OLED") display, an electroluminescent display ("ELD"), a surface-conduction electron emitter display ("SED"), a field-emission display ("FED"), a thin-film transistor ("TFT") LCD, a bistable cholesteric reflective display (i.e., e-paper), etc. The user interface also can be configured with a microcontroller to display conditions or data associated with the main device in real-time or substantially real-time.

Motion of the remote control vehicle 100 can be powered with an electric motor (not shown). The electric motor is preferably powered with rechargeable batteries 114, such as the lithium ion 9.6v batteries, however it is to be appreciated any suitable dry cell battery may be used, including use of a lead-acid battery, a low self-discharge nickel metal hydride battery ("LSD-NiMH") battery, a nickel-cadmium battery ("NiCd"), a or a lithium-ion polymer ("LiPo") battery. Careful attention should be taken if using a lithium-ion battery or a LiPo battery to avoid the risk of unexpected ignition from the heat generated by the battery. While such incidents are rare, they can be minimized via appropriate design, installation, procedures and layers of safeguards such that the risk is acceptable.

Sensors 116 can be provided with the remote control vehicle 100 which sense one or more characteristics of an object and can include, for example, accelerometers, position sensors, pressure sensors (including weight sensors), or fluid level sensors (fuel gauges) among many others. The accelerometers can sense acceleration of an object in a variety of directions (e.g., an x-direction, a y-direction, etc.). The position sensors can sense the position of one or more components of an object. For example, the position sensors can sense the position of an object relative to another fixed object such as a wall. Pressure sensors can sense the pressure of a gas or a liquid or even the weight of an object. The fluid level sensors can sense a measurement of fluid contained in a container or the depth of a fluid in its natural form such as water in a river or a lake, which are especially useful where the remote control vehicle 100 is a watercraft. Fewer or more sensors can be provided as desired. For example, a rotational sensor can be used to detect speed(s) of object(s), a photodetector can be used to detect light or other electromagnetic radiation, a distance sensor can be used to detect the distance an object has traveled, a timer can be used for detecting a length of time an object has been used and/or the length of time any component has been used, and a temperature sensor can be used to detect the temperature of an object or fluid.

In embodiments where sensors 116 are employed and connect data, the data can be wirelessly communicated to other computer devices and/or stored for further analysis. Where the data is stored, the remote control vehicle 100 can include one or more communications ports such as Ethernet, serial advanced technology attachment ("SATA"), universal serial bus ("USB"), or integrated drive electronics ("IDE"), for transferring, receiving, or storing data.

Product packaging 90 can also be included with the kit 150 disclosed herein. Such product packaging 90 may be useful for shipping kits to children in a compact manner prior to first play. The product packaging 90 may completely subsume the remote control vehicle 100 and all of the components therein or may only encompass a portion thereof. The product packaging 90 will typically include plastics, thermoplastics, glass, wood, wood wool, paper, paperboard, corrugated cardboard, other biodegradable or recyclable materials, and/or the like. Optionally, the product packaging 90 can include a product and/or source identifier 91, such as a word or trade mark, on the packaging 90; a viewing window 92 for viewing at least one component and/or the entirety of the toy system or kit on or near the product packaging 90; instructions 93 for play, assembly, and/or configuring (e.g. resetting) the remote control vehicle 100 in connection with the emulated biological processes described herein; a hang tab 94 from which the packaging can hang from shelves in public stores; and/or perforations, folds, pull strings, and/or other predefined points of failure 95 which facilitate ripping, cutting, and/or opening the product packaging 90. The product packaging 90 should be selectively placed on shelves and/or in store locations such that the kit is best marketed to/for children.

As particularly shown in FIGS. 2-8 and FIGS. 9A-9C, the remote control vehicle 100 can include holes 104 in the body 102 (FIGS. 2-5) and/or channels 104 (FIGS. 6-8 and 9A-9C) in the body 102 and/or wheels 106. The channels or holes 104 allow for EL wires/pipes to be placed therethrough or therein, thereby allowing a user to be able to customize the look and/or function of the remote control vehicle 100. The remote control vehicle 100 can still be re-piped and customized after an initial use.

FIGS. 10-14 relate to specific non-limiting, exemplary embodiments of the remote control vehicle 100.

Figure 10:
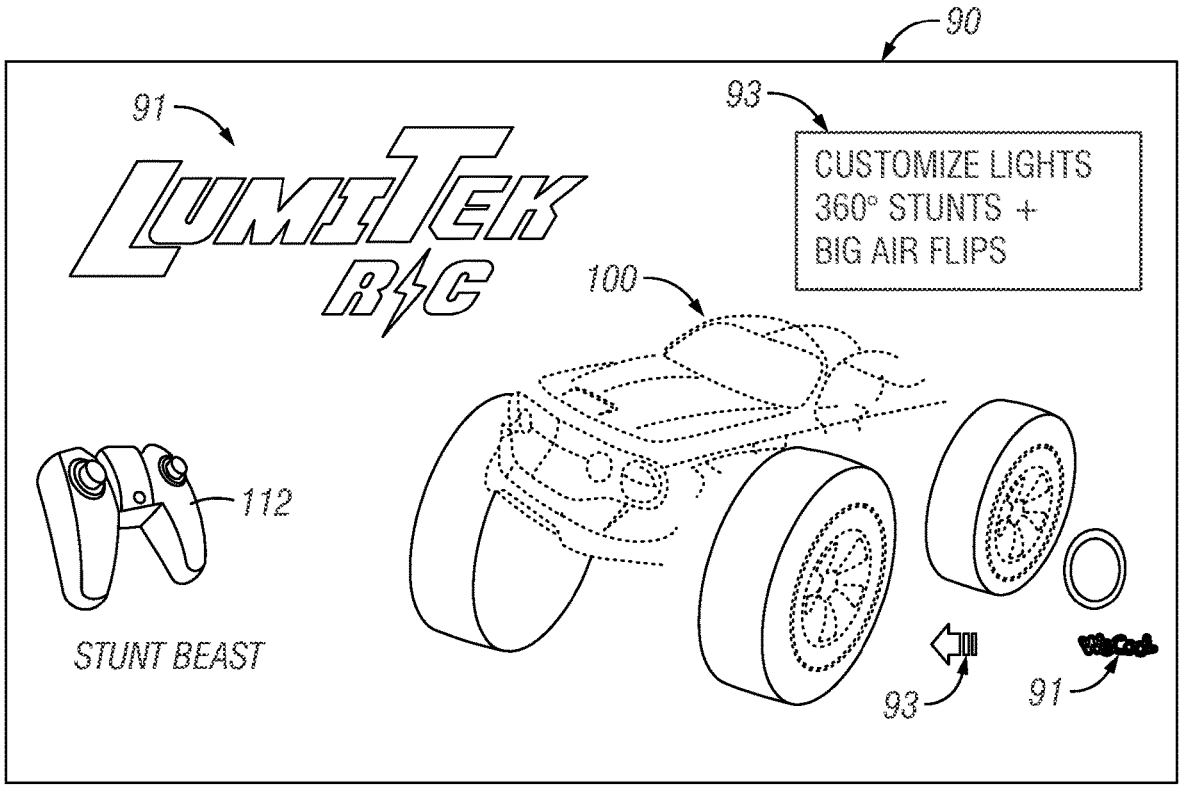
FIG. 10 shows an embodiment of a remote control model with channels or holes that can secure light fixtures thereto, said embodiment emulating the look of a stunt vehicle.

The remote control vehicle 100 of FIG. 10 is a stunt vehicle (high speed car) capable of flipping, spinning, and turning with a push of a button. The high speed RC car of this embodiment races on both sides of the car and features grippy rubber tires to off road race on any terrain. The RC car is both compact and durable. The user is given the ability to engage a 360° spin mode, which allows for 360° flips and spins. The remote control car of this embodiment can spin on two wheels as it lights up with vibrant lights, and can be equipped with a wheelie bar, if desired. It is preferred the remote control vehicle 100 of this embodiment be provided with a 2.4 GHz remote transmitter 112, two 3.7V 500 mAh lithium-ion (Li-ion) rechargeable batteries 114, four AA Batteries 114, and a universal serial bus ("USB") charging cable.

Figure 11:
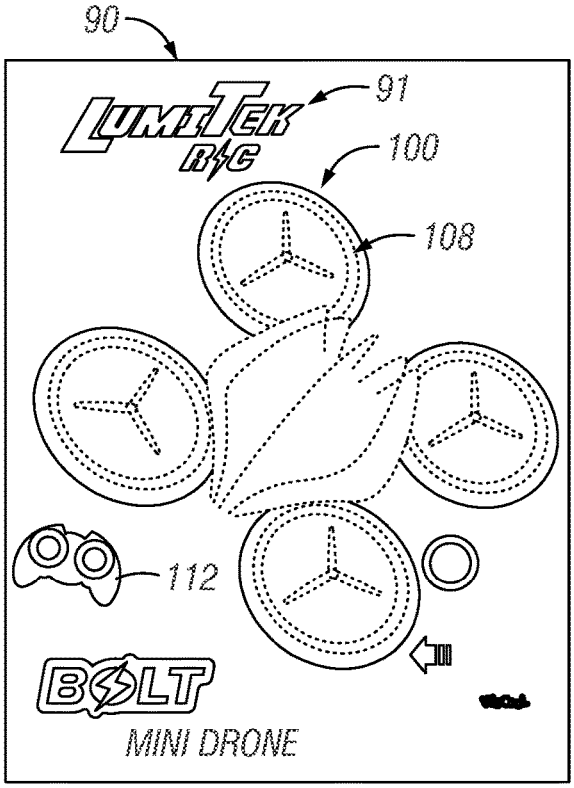
FIG. 11 shows an embodiment of a remote control model with channels or holes that can secure light fixtures thereto, said embodiment emulating the look of a drone.

The remote control vehicle 100 of FIG. 11 is a drone capable of flight by way of four symmetrically oriented fans located toward a periphery of the aerial vehicle's body 102. Like the RC car above, the drone should be compact and durable, but should also be somewhat light so as to facilitate flight. It is preferred the drone of this embodiment be included with three remotes 112: a standard mini remote, a G-sensor (116; not shown) watch remote, and a water-drop-shaped remote. The light fixtures 108 emulating neon lighting make flight of the drone capable of being controlled at night. The drone can thus put on a stunning light show via bright light strips, which add glow to high-speed rotation, circle fly and any other functions. Two detachable batteries 114 can, for example, allow for a longer journey up to 16 minutes, though embodiments permitting flight for a greater time are certainly possible if the drone is equipped according to other application-specific specifications. The drone can help kids (and particularly high-school aged students) develop hand-eye coordination and a better understanding of flight principles, including lift, thrust, drag, and the like. The drone can be controlled for a range and a height of at least fifty meters.

Figure 12:
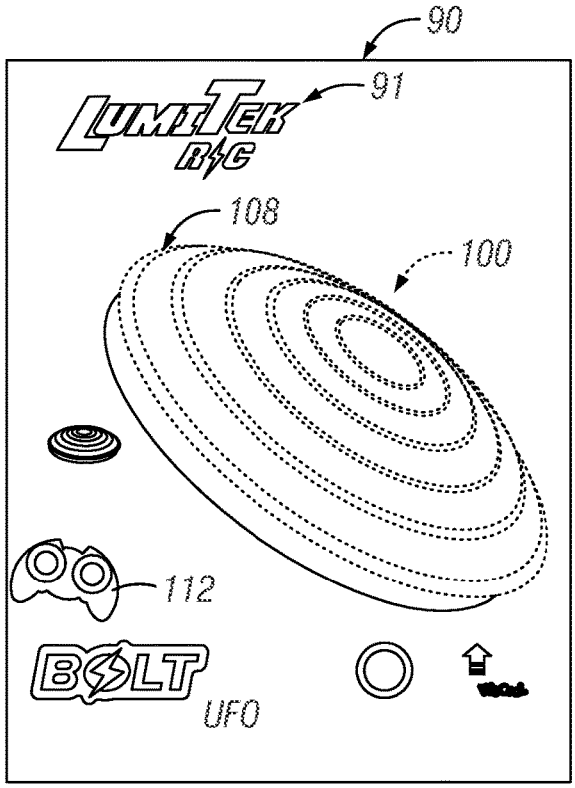
FIG. 12 shows an embodiment of a remote control model with channels or holes that can secure light fixtures thereto, said embodiment emulating the look of a flying saucer (also commonly referred to as an unidentified flying object ("UFO").

The remote control vehicle 100 of FIG. 12 is a saucer capable of flight. The flying saucer can thus include any one or more aspects of the drone described above, but also preferably includes a hand sensor 116 that is motion activated.

Figure 13:
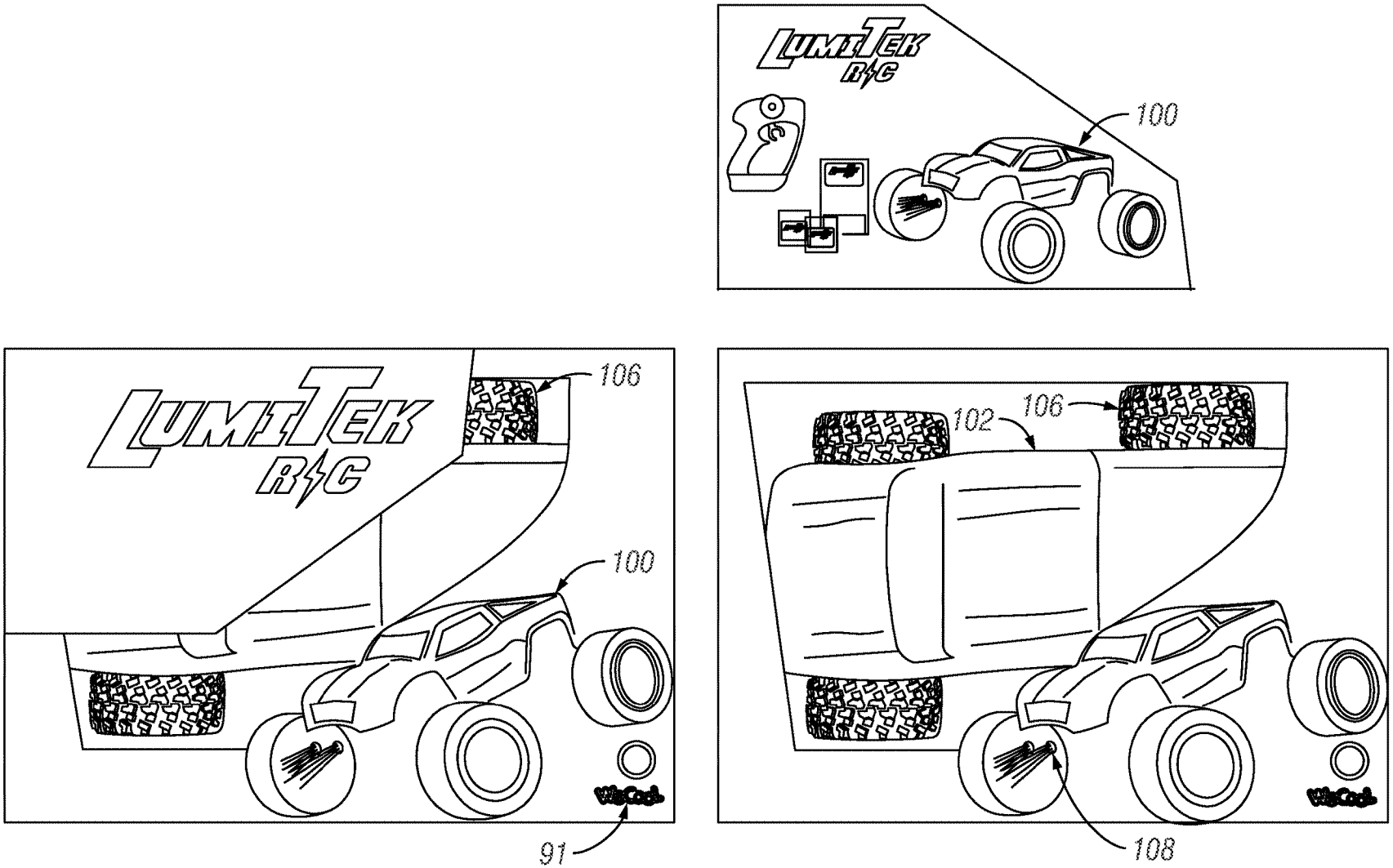
FIG. 13 shows an embodiment of a remote control model with channels or holes that can secure light fixtures thereto, said embodiment emulating the look of a an all-terrain vehicle (ATV).

The remote control vehicle 100 of FIG. 13 is an all-terrain vehicle ("ATV") capable of flipping, spinning, and turning with a push of a button. The ATV can thus include any one or more aspects of the high speed car described above, but preferably includes slick rear wheels for drifting and durability. The body 102 is a steady chassis and houses a strong power motor, the speedy 2.4 GHz scale RC ATV can be run by first installing the battery and turning on the power switch on the remote 112.

Figure 14:
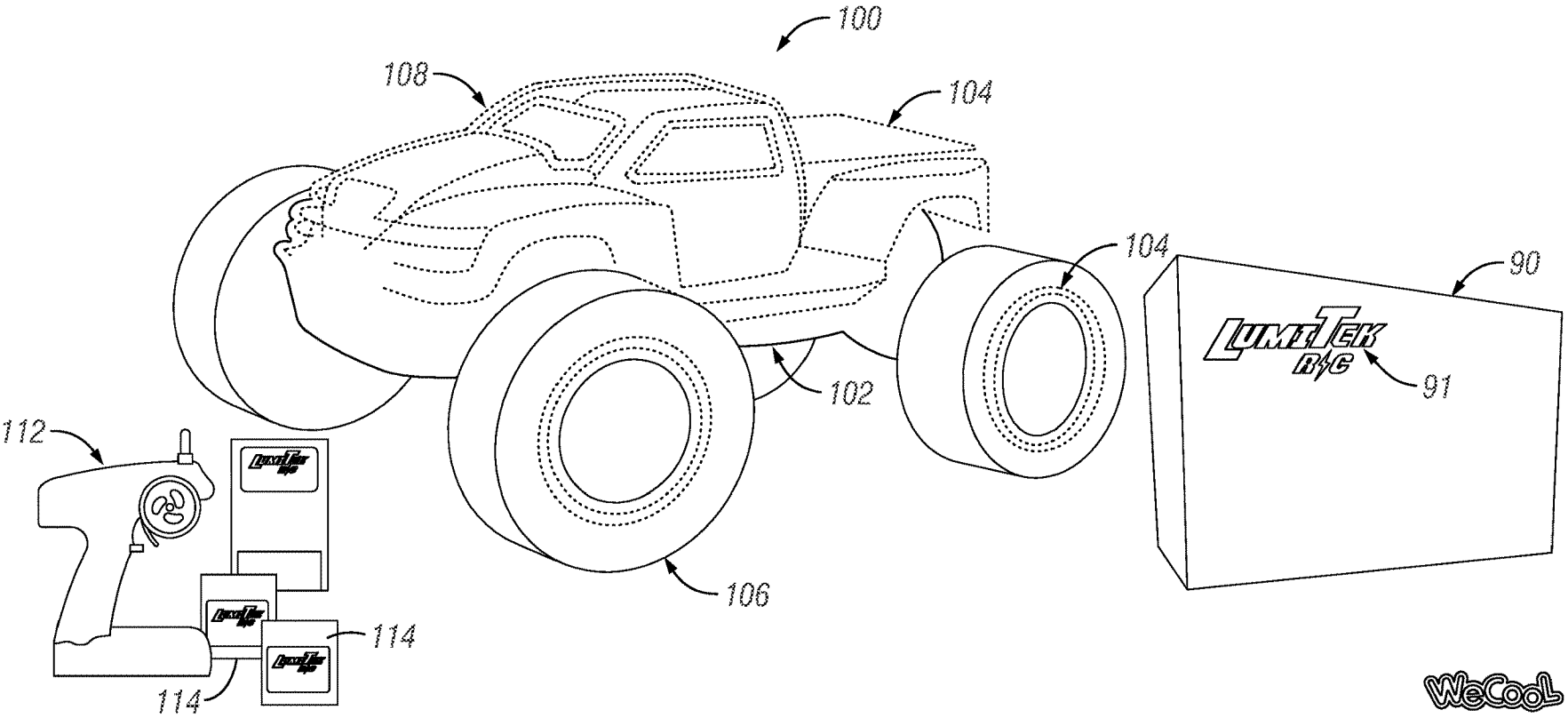
FIG. 14 shows a perspective, featured view of a remote control truck retrofit with selected and/or customizable lights and corresponding product packaging.

The remote control vehicle 100 of FIG. 14 can be a 1:10 scale off-road 4×4 truck. Accessories such as the rugged, adjustable wheelie bar 110 shown in FIG. 16 can be included to promote the ability of the remote control vehicle 100 to perform tricks such as rolling, flipping, spinning, and the like. Moreover, other robust mechanical and/or electrical apparatuses can be employed to improve the maximum range, speed, operational time, climbing angle, weight limit, and/or other specifications of the remote control vehicle 100.

The remote control vehicle 100 can be adapted to be a model of another high-speed car. The high-speed car of this embodiment preferably includes: anti-skid rubber tires, a shock absorbing and front and rear suspension system to handle sand, mud, stone rugged mountain roads. The model is a 1:10 scale model and includes a durable design to give endless entertainment both off-road and on-road. Four wheel drive and a wheel bar are preferably included.

According to some embodiments, a person may be broadcasted by way of an electronic recording device on a social media platform playing with the remote control vehicle 100. Alternatively, said persons may broadcast data. The broadcasted data can include video data, historic or real-time data, associated with operation of the remote control vehicle 100, data related from sensed characteristics (e.g. velocity, power remaining, etc.), and/or the like. Data can be stored in a traditional database, such as those located on physical hard drives, or electronically, such as where cloud-based storage systems are employed. Children can compare or showcase in a virtual showroom results of play and/or configuring their remote control vehicle 100. This may potentially lead to the children inquiring about the best methods of play or customizing the remote control vehicle 100. Said sharing may occur via any suitable wireless/wired electronic network and/or social media platforms and/or through/with any suitable computerized graphical user interface.

From the foregoing, it can be seen that the present invention accomplishes at least all of the stated objectives.

LIST OF REFERENCE CHARACTERS

The following reference characters and descriptors are not exhaustive, nor limiting, and include reasonable equivalents. If possible, elements identified by a reference character below and/or those elements which are near ubiquitous within the art can replace or supplement any element identified by another reference character.

TABLE 1

| List of Reference Characters | |
|---|---|
| 80 | packaging |
| 81 | neon lighting |
| 90 | packaging |
| 91 | product/source identifier |
| 92 | viewing window |
| 93 | instructions |
| 94 | hang tab |
| 95 | predefined points of failure (e.g. perforations) |
| 100 | remote control vehicle |
| 102 | body |
| 104 | channels/holes |
| 106 | wheels |
| 108 | light fixtures |
| 110 | wheelie bar |
| 112 | remote control |
| 114 | battery |
| 116 | sensor |

Glossary

Unless defined otherwise, all technical and scientific terms used above have the same meaning as commonly understood by one of ordinary skill in the art to which embodiments of the present invention pertain.

The terms "a," "an," and "the" include both singular and plural referents.

The term "or" is synonymous with "and/or" and means any one member or combination of members of a particular list.

The terms "invention" or "present invention" are not intended to refer to any single embodiment of the particular invention but encompass all possible embodiments as described in the specification and the claims.

The term "about" as used herein refer to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variable, given proper context.

The term "generally" encompasses both "about" and "substantially."

The term "configured" describes structure capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

The term "play" can be used herein as an adjective, a verb, a noun, or any other suitable part of speech given proper context. As an adjective, "play" means relating to an activity engaged in for enjoyment and recreation, especially by children. As a verb, "to play" means to engage in a game or activity for enjoyment or recreation. As a noun, "play" means an activity engaged in for enjoyment and recreation.

A "light fixture", "light fitting", or "luminaire" is an electrical device that contains an electric lamp that provides illumination. All light fixtures have a fixture body and one or more lamps. The lamps may be in sockets for easy replacement—or, in the case of some light-emitting diode ("LED") fixtures, hard-wired in place.

The term "neon lighting" refers to brightly glowing, electrified glass tubes or bulbs that contain rarefied neon (produces a generally orange color) and/or other gases, such as hydrogen (red), helium (yellow), carbon dioxide (white), and mercury (blue). Neon lights are typically type of cold cathode gas-discharge light, such as those which utilize a sealed glass tube with a metal electrode at each end, filled with one of a number of gases at low pressure.

The "scope" of the present invention is defined by the appended claims, along with the full scope of equivalents to which such claims are entitled. The scope of the invention is further qualified as including any possible modification to any of the aspects and/or embodiments disclosed herein which would result in other embodiments, combinations, subcombinations, or the like that would be obvious to those skilled in the art.

What is claimed is:

1. A remote control vehicle that can be operated in the day or at night comprising:

a customizable body with channels or holes for housing light fixtures which emulate the effects of neon lighting;

a motor for propelling motion of the customizable body, said motor being enclosed within a watertight housing;

a remote control capable of remotely communicating aspects related to the control of the remote control vehicle, said aspects including at least steering and acceleration;

all-terrain wheels that include channels for housing more light fixtures emulating the effects of neon lighting, wherein the channels of the all-terrain wheels are located toward the vehicle's outermost exterior so that operators can easily determine exactly where at least some of the outer bounds of the vehicle lie even at night, wherein each of the channels are formed in a stationary portion of a corresponding wheel assembly that is non-rotating with respect to an axle of the wheel assembly, wherein the stationary portion houses a continuous circumferential light emitter that remains fixed while a tire of the wheel rotates, wherein electrical power for the continuous circumferential light emitter is provided by a conductor routed along at least a portion of the axle to the stationary portion, and wherein rear wheels of the all-terrain wheels are slick so as to enable drifting; and a structure selected from the group consisting of: a roll cage, a wheelie bar, and rotatable handlebars, wherein the structure allows for 360° flipping, rolling, or spinning of the vehicle; and means for quickly entering pre-programmed inputs for instructing the remote control vehicle to flip, roll, or spin the vehicle.

2. The remote control vehicle of claim 1, wherein the remote control vehicle is a radio-controlled (RC) model of an automobile.

3. The remote control vehicle of claim 1 wherein the aspects further comprise braking.

4. The remote control vehicle of claim 1 wherein the motor is powered by:

a battery; or fuel.

5. The remote control vehicle of claim 1 wherein the remote control includes buttons, switches, or joy-sticks.

6. The remote control vehicle of claim 1 further comprising sensors which collect data related to said aspects.

7. The remote control vehicle of claim 1 wherein the light fixtures comprise light emitting diodes (LEDs) or electroluminescent (EL) wires.

8. The remote control vehicle of claim 1 wherein the customizable body is a transparent wireframe customizable body, and further wherein a center of gravity of the transparent wireframe customizable body is low enough such that the transparent wireframe customizable body skids before flipping.

9. A kit comprising:

the remote control vehicle according to claim 1;

at least two rechargeable batteries;

a container of neon glow paint or a neon-ink based marker;

a charger; and product packaging for storing at least some components of the kit between uses.

10. The kit of claim 9 further comprising a track with built-in light fixtures emulating the effects of neon lighting.

11. The kit of claim 9 further comprising interchangeable or replacement LEDs.

12. A remote control vehicle that can be operated in the day or at night comprising:

a customizable body with channels or holes for housing light fixtures which emulate the effects of neon lighting;

a motor for propelling motion of the customizable body, said motor being enclosed within a watertight housing;

a remote control capable of remotely communicating aspects related to the control of the remote control vehicle, said aspects including at least steering and acceleration;

all-terrain wheels that include channels for housing more light fixtures emulating the effects of neon lighting, wherein each of the channels are formed in a stationary portion of a corresponding wheel assembly that is non-rotating with respect to an axle of the wheel assembly, wherein the stationary portion houses a continuous circumferential light emitter that remains fixed while a tire of the wheel rotates, wherein electrical power for the continuous circumferential light emitter is provided by a conductor routed along at least a portion of the axle to the stationary portion, wherein the channels of the all-terrain wheels are located toward the vehicle's outermost exterior so that operators can easily determine exactly where at least some of the outer bounds of the vehicle lie even at night; and a wing;

one or more actuatable trim tabs that help an operator control flight of the remote control vehicle.

* * * * *